United States Patent [19]

Yahagi et al.

[11] 4,036,276

[45] July 19, 1977

[54] METHOD OF SHAPING A MOULD UNDER A REDUCED PRESSURE

[75] Inventors: Kyozo Yahagi; Takashi Yasukuni, both of Mihara, Japan

[73] Assignee: Mitsubishi Jukogyo Kabushiki Kaisha, Tokyo, Japan

[21] Appl. No.: 617,164

[22] Filed: Sept. 26, 1975

[30] Foreign Application Priority Data

Sept. 30, 1974 Japan ..... 49-111635

[51] Int. Cl.[2] ..... B22C 1/16

[52] U.S. Cl. ..... 164/7; 164/23; 164/33; 164/41; 164/160; 164/253; 164/379; 164/380

[58] Field of Search ..... 164/7, 27, 41, 23, 33, 164/44, 160, 253, 379, 380, 382, 411

[56] References Cited

U.S. PATENT DOCUMENTS

| | | | |
|---|---|---|---|
| 2,789,331 | 4/1957 | Dietert | 164/27 |
| 3,581,802 | 6/1971 | Krzyzanowski | 164/7 X |
| 3,789,907 | 2/1974 | Nakata et al. | 164/7 |
| 3,952,793 | 4/1976 | Hiyikata et al. | 164/253 X |
| 3,961,967 | 6/1976 | Brooks | 164/33 X |
| Re. 24,655 | 6/1959 | Sylvester | 164/27 |

*Primary Examiner*—Ronald J. Shore
*Attorney, Agent, or Firm*—Cushman, Darby & Cushman

[57] ABSTRACT

A method of producing a reduced-pressure-shaped mould in which at least in the region of a sprue runner of the mould to be formed and in regions where a shield material for the mould material is likely to be destroyed during introduction of the molten material to be moulded, the mould material partially or entirely comprises moulding sand mixed with substantially 0.5% to substantially 3.0% by weight of binder.

2 Claims, 2 Drawing Figures

METHOD OF SHAPING A MOULD UNDER A REDUCED PRESSURE

The present invention relates to improvements in a method of shaping a mould under reduced pressure.

In such a method a desired shape of mould is produced by establishing a negative pressure in the interstices between sand particles forming a mould material and by making use of the pressure difference between said interstices and a cavity formed by means of a pattern.

Such a prior art method will now be described with reference to FIG. 1 which shows a schematic cross-section of a mould which has been shaped according to the conventional method.

Figure 2:
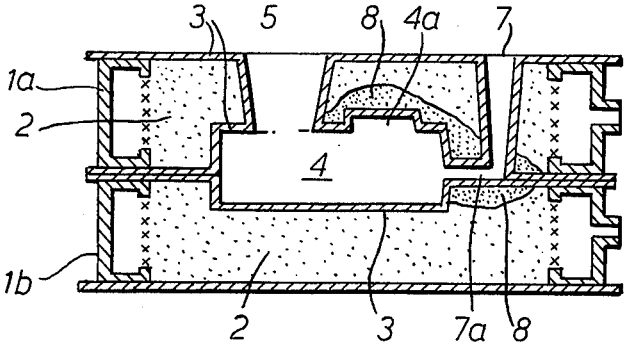

FIG. 2 illustrates illustrates a mold produced by a method according to the present invention.

Figure 1:
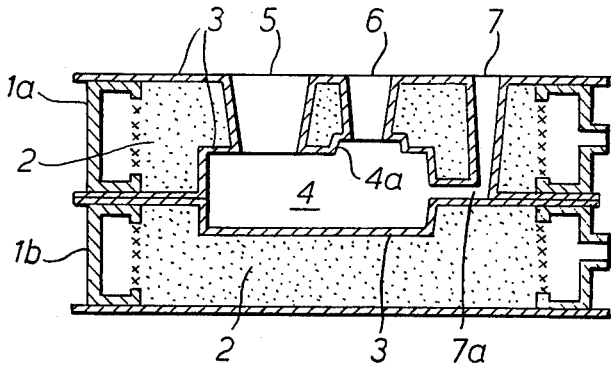
FIG. 1. PRIOR ART

In FIG. 1, upper and lower flasks 1*a* and 1*b* are provided with evacuating means. The flasks are filled with moulding sand 2 not containing a binder and covered with a shield 3 in the form of an airtight film to enable a negative pressure to be maintained within the moulding sand 2. The shields are shaped on patterns (not shown) to produce a mould cavity 4, which is open at a dead head 5 which serves also as an air communication hole, an air communication hole 6, and an ingate 7 for molten metal. When a molten metal is poured into the cavity portion 4 through the ingate 7, where the mould cavity 4 has a recess 4*a* on its upper surface as shown the shield 3 will burn out in the region of the recess 4*a* with the result that the cavity 4 communicates with the interstices in the moulding sand 2 and the pressure within the cavity 4 approaches the pressure in the moulding sand 2 and becomes negative. This causes moulding defects such as deformation to occur.

Therefore, in the prior art method, in order to prevent the pressure within the cavity portion 4 from becoming negative, there is especially provided an air communication hole 6 communicating with the atmosphere. However, depending upon the shape of the moulded products to be produced, it often becomes necessary to provide a large number of air communication holes 6 in all such recesses 4*a*. Providing a necessary number of air communication holes 6 in each case not only results in lowering of yields of the products (because the molten metal would enter into the air communication holes 6), but also troublesome work is needed to provide the air communication holes 6, such as preliminarily adsorbing or pasting a shield (airtight film) 3 onto the surface of the pattern for forming the air communication holes (not shown), or taping the contact surface between the pattern for forming the air communication holes and the pattern for forming the mould, and in addition, there remain problems with respect to common usefulness of the flasks 1*a* and 1*b*. For instance, even in case that the inside dimensions of the flasks 1*a* and 1*b* are 1,000 mm × 1,000 mm or larger or smaller, depending upon the shape of the products, there are provided suction pipes (not shown) within the flasks for the purpose of equalizing the negative pressure within the moulding sand, and in such cases the arrangement of the air communication holes are restricted because the suction pipes and the air communication holes interfere with each other, so that there was a disadvantage that the shape of the products is restricted. In addition, there is a disadvantage that a protecting sleeve tube (not shown) had to be provided in the ingate 7 and its sprue runner 7*a*, because unless the protecting sleeve tube is used in the ingate 7 and its sprue runner 7*a* the shield 3 along the upper surface of the sprue runner 7*a* would burn out owing to a turbulent flow of the molten metal, resulting in weakening of the mechanical strength of the moulding sand, and thereby moulding defects would occur such as the so-called "washed defects" or "disturbed defects".

The object of the present invention is to mitigate the disadvantages and shortcomings of moulds shaped according to the aforementioned conventional method.

For a better understanding of the present invention and to show how it may be carried into effect, reference will now be made, by way of example, to FIG. 2 of the accompanying drawings which is a schematic cross-section of a mould which has been produced by a method according to the present invention.

The mould of FIG. 2 operates in a similar fashion to that shown in FIG. 1 and like parts, which are similarly constructed and have the same function, are represented by the same reference numerals. In particular the mould material 2 is moulding sand containing no water or binder at all.

Reference numeral 8 designates moulding material having a low caking power consisting of moulding sand mixed with 0.5 – 3.0% weight of binder, which is partly or entirely used in place of the moulding sand 2 in the entire upper surface portion of the recess 4*a* above the cavity 4 (which surface portion is shielded from the atmosphere by the shield 3 upon the pouring of molten metal), and also in the upper surface portion of the ingate 7 and in the sprue runner 7*a*, when the moulding sand 2 is poured into the flasks 1*a* and 1*b*. The moulding material 8 is moulding sand having some caking power comprising basically fine granular sand (including zircon sand, chromite sand, olivine sand, etc.) of the order of Nos. 5 – 8 in size, added with a binder of 0.5 – 3.0% weight for making it retain some mechanical strength at an elevated temperature. As the binder to be added, a mixture is used of 0.5 – 2.0% clay and 0.5 – 2.0% water in case of a green sand mould. 05. – 2.0% sodium silicate in case of a gas mould, 0.5 – 3.0% cement in case of a cement mould, or 0.5 – 3.0% furan, alkyl, etc. in case of a resin mould. To make each part of the mould, the shield 3 is first shaped by suctions on a pattern. The flask 1*a* or 1*b* is then placed on the shield 3, filled with moulding material and covered. The flask is then submitted to reduced pressure by the evacuating means. The mould cavity is then formed from putting together the cavities formed adjacent the shields of the two flasks.

In this method, when the moulding sand is introduced into the flask moulding material 8 having a low caking power is used partly or entirely as pocket sand in place of the moulding sand 2, not containing a binder, into the surface portion of the recess 4*a* of the mould cavity portion to be shaped, which surface portion is shielded from the atmosphere by the shield 3 upon the pouring, and also into the upper surface portion of the sprue runner 7*a* which surface portion is apt to be washed by molten metal.

When the interstices of the moulding sand 2 and 8 are reduced in pressure up to a negative pressure in the conventional manner with the evacuating means of the flasks 1*a* and 1*b*, similarly to the conventional method, a cavity bounded by the shield 3 can be formed. However, in this case, the water in the sodium silicate contained in the moulding sand 8 having a low caking power, that is locally filled into the upper surface portions beyond the shield 3 of the recess 4*a* and the sprue runner 7*a* of the cavity 4, is dehydrated due to the negative pressure, and thus the moulding material 8 has a mechanical strength and also retains a sufficient mechanical strength against the heat of the molten metal upon the pouring step. Accordingly, deformation of the recess 4*a* formed by the moulding material 8 as well as defects of castings such as mixing of sand which is caused by the fact that the sprue runner 7*a* is washed by the molten metal, would not occur.

It is to be noted that in this case if the fluidity of the moulding material 8 having a low caking power is poor, then the so-called "packing" of the moulding sand upon filling the same is degraded, and as a result the interstices between sand granules become large in comparison to the moulding sand 2 not containing the binder, so that upon pouring a molten metal into the mould there is a possibility that the molten metal may enter into the interstices and may cause the so-called penetration phenomena. However, if the above-referred compounding ratio is kept, then this will not happen and a good surface of castings is produced. The shake-out capability upon removing the mould after the pouring step differs very little from that of the moulding sand not containing a binder, and thus the advantages of the reduced-pressure shaping method are not lost at all.

Since the method described with reference to FIG. 2 has the aforementioned features and effects, the method can realize the following practical advantages:

1. A mould which would not cause moulding defects such as mould deformation, washing or the like upon pouring, can be obtained through a reduced-pressure shaping method.
2. Since the air communication hole 6 provided according to the conventional method becomes unnecessary, not only that the yield is enhanced and the working steps are reduced, but also general utility of the flask is increased.

We claim:

1. In a method for producing a cavity mould, wherein:

a flask is filled with moulding sand not containing a binder and covered with an airtight film which constitutes a shield having an ingate and sprue runner; a pattern is placed on the shield and the shield is formed thereabout; negative pressure is drawn on the moulding sand through the flask to maintain a mould cavity in the shape of the pattern and the pattern is removed;

the improvement wherein:

when the flask is being filled with moulding sand, instead of entirely using moulding sand not containing a binder, in the region of the mould sprue runner and elsewhere adjacent the shield where the shield is likely to be destroyed during introduction of molten metal into the mould cavity, the moulding sand not containing a binder is omitted, and instead thereof there is filled into those regions of the flask moulding sand mixed with 0.5–3.0 percent binder, by weight.

2. A reduced-pressure shaped mould, comprising:

a flask having means drawing a vacuum therethrough;

said flask containing a filling of moulding sand;

said flask also having an airtight film covering, including a portion lining surface means of the moulding sand and defining a mould cavity with an ingate and sprue runner communicating with the mould cavity;

said moulding sand not containing binder, except by said surface means about the sprue runner and by said surface means elsewhere where the shield is likely to be destroyed during introduction of molten metal into the mould cavity, the moulding sand of these exceptions being mixed with 0.5–3.0 weight percent binder.

* * * * *